US006131634A

United States Patent [19]

Chang

[11] Patent Number: 6,131,634

[45] Date of Patent: Oct. 17, 2000

[54] PORTABLE STRAPPING APPARATUS

[76] Inventor: Jeff Chieh Huang Chang, No. 34-3, Lane 101, 38th Road, Taichung Industrial Park, Taichung, Taiwan

[21] Appl. No.: 09/321,105

[22] Filed: May 27, 1999

[51] Int. Cl.[7] ..... B65B 13/32

[52] U.S. Cl. ..... 156/494; 156/73.5; 156/579; 156/580; 100/32; 100/33 PB

[58] Field of Search ..... 156/73.5, 229, 156/494, 502, 579, 580, 583.1; 100/29, 32, 33 PB

[56] References Cited

U.S. PATENT DOCUMENTS

| | | | |
|---|---|---|---|
| 4,050,372 | 9/1977 | Kobiella | 156/73.5 X |
| 4,313,779 | 2/1982 | Nix | 156/361 |
| 4,820,363 | 4/1989 | Fischer | 156/494 |
| 5,306,383 | 4/1994 | Kobiella | 156/468 |
| 5,380,393 | 1/1995 | Drabarek et al. | 156/358 |
| 5,476,569 | 12/1995 | Harada | 156/502 |
| 5,632,851 | 5/1997 | Young | 156/494 |
| 5,942,061 | 8/1999 | Figiel et al. | 156/73.5 |
| 5,954,899 | 9/1999 | Figiel et al. | 156/73.5 |
| 6,003,578 | 12/1999 | Chang | 156/494 |

*Primary Examiner*—James Sells
*Attorney, Agent, or Firm*—Rosenberg, Klein & Lee

[57] ABSTRACT

A portable strapping apparatus has a semi-automatic fastening mechanism that uses a transmission unit in conjunction with a unidirectional bearing to drive a tensioning wheel. The tensioning wheel is provided with two slots arranged in a mutually perpendicular manner or a plurality of slots, by which the tensioning wheel can achieve a better binding strength. For facilitating the welder to push two strapping bands to positively abut against each other, an elastic presser located on one side of the tensioning wheel is used to gradually release strapping bands before welding. Thus the strapping apparatus according to the invention can positively perform the welding and cutting of strapping bands to effectively bind articles.

4 Claims, 5 Drawing Sheets

PORTABLE STRAPPING APPARATUS

BACKGROUND OF THE INVENTION

A conventional portable strapping apparatus has the shortcoming that it can not give strapping bands a sufficient tension and the strapping band is easily worn due to friction when it wraps strapping bands around an object. This is due to its imperfect tensioning mechanism design. On the other hand, average manually operated strapping apparatus can gradually stretch a strapping band until the band reaches a preset tension. However the operation of a manual strapping apparatus is slow in speed and poor in efficiency. Such apparatuses are not suitable for use with an automatic welding machine. Thus they can not meet the practical requirement in the industry.

In view of the above problem, the present invention is to provide a new type of portable strapping apparatus that comprises an innovative automatic tensioning and release mechanism that can be used in conjunction with automatic welding apparatuses and that can achieve a high efficiency that has never been seen in a conventional machine. Now the structure and features of the invention will be described in detail with reference to the accompanying drawings.

BRIEF DESCRIPTION OF ACCOMPANYING DRAWINGS

DETAILED DESCRIPTION OF PREFERRED EMBODIMENTS

Figure 1:
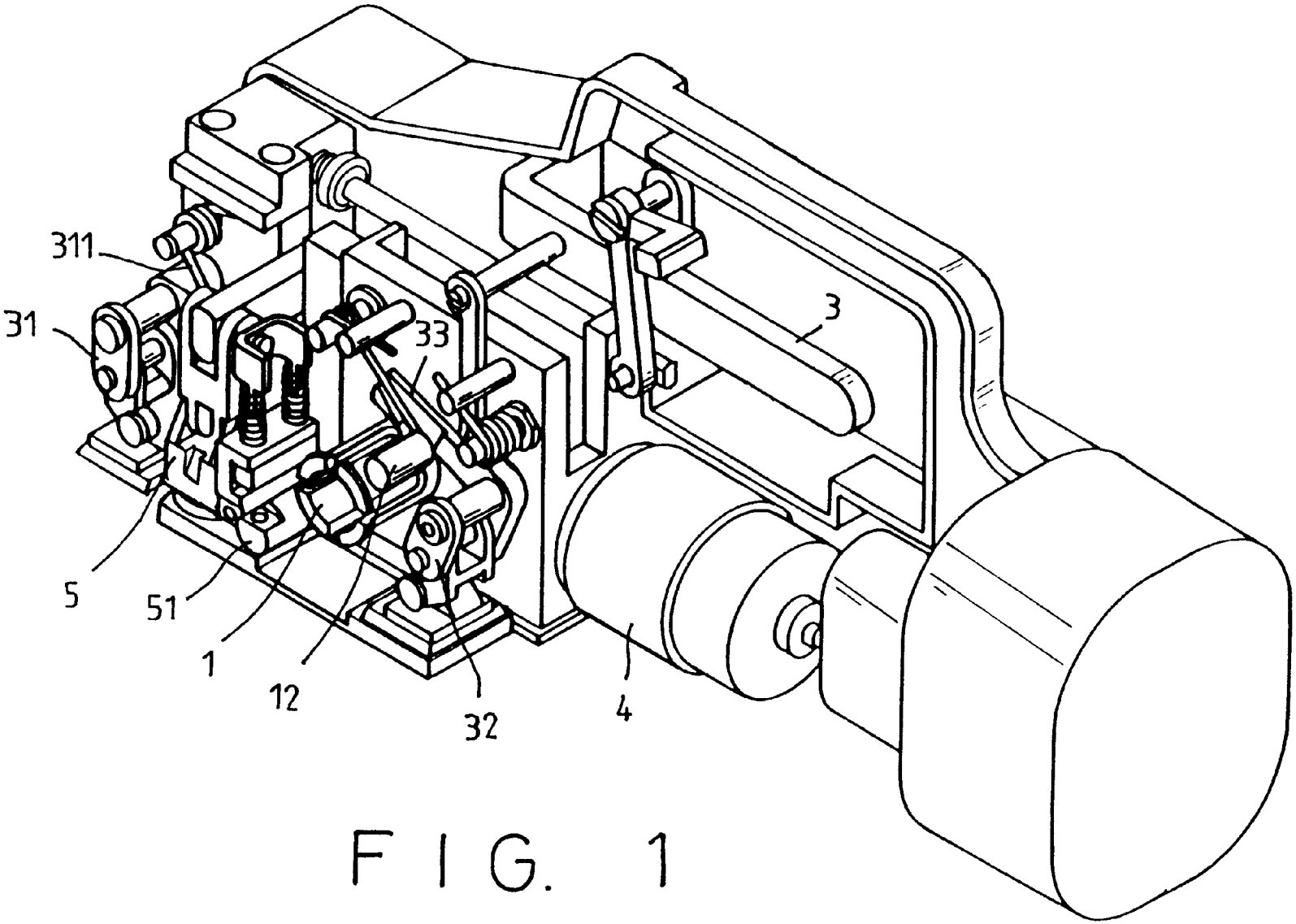
FIG. 1 is a perspective view of a preferred embodiment of a portable strapping apparatus according to the invention.

Referring to FIG. 1, the invention is a portable strapping apparatus comprising a base plate (2) on which a motor (4), a transmission mechanism, a welding mechanism (5), a handle (3) and a tensioning wheel (1) are mounted. The motor (4) drives the transmission mechanism to govern the operation of the tensioning wheel (1) and the welding mechanism (5) to fasten an object with a strapping band.

Figure 2:
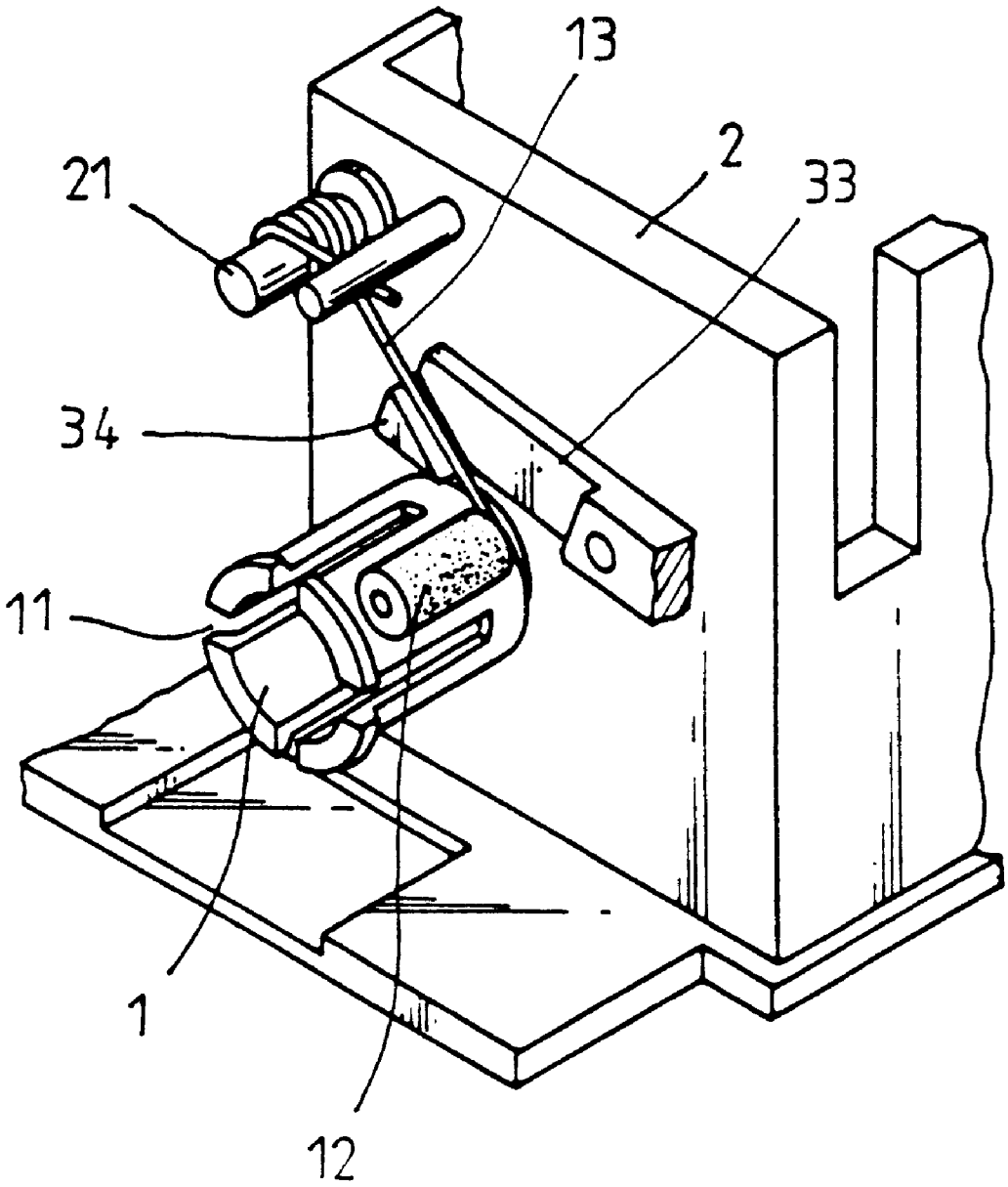
FIG. 2 is a perspective view showing the tensioning mechanism of the invention.
Figure 3:
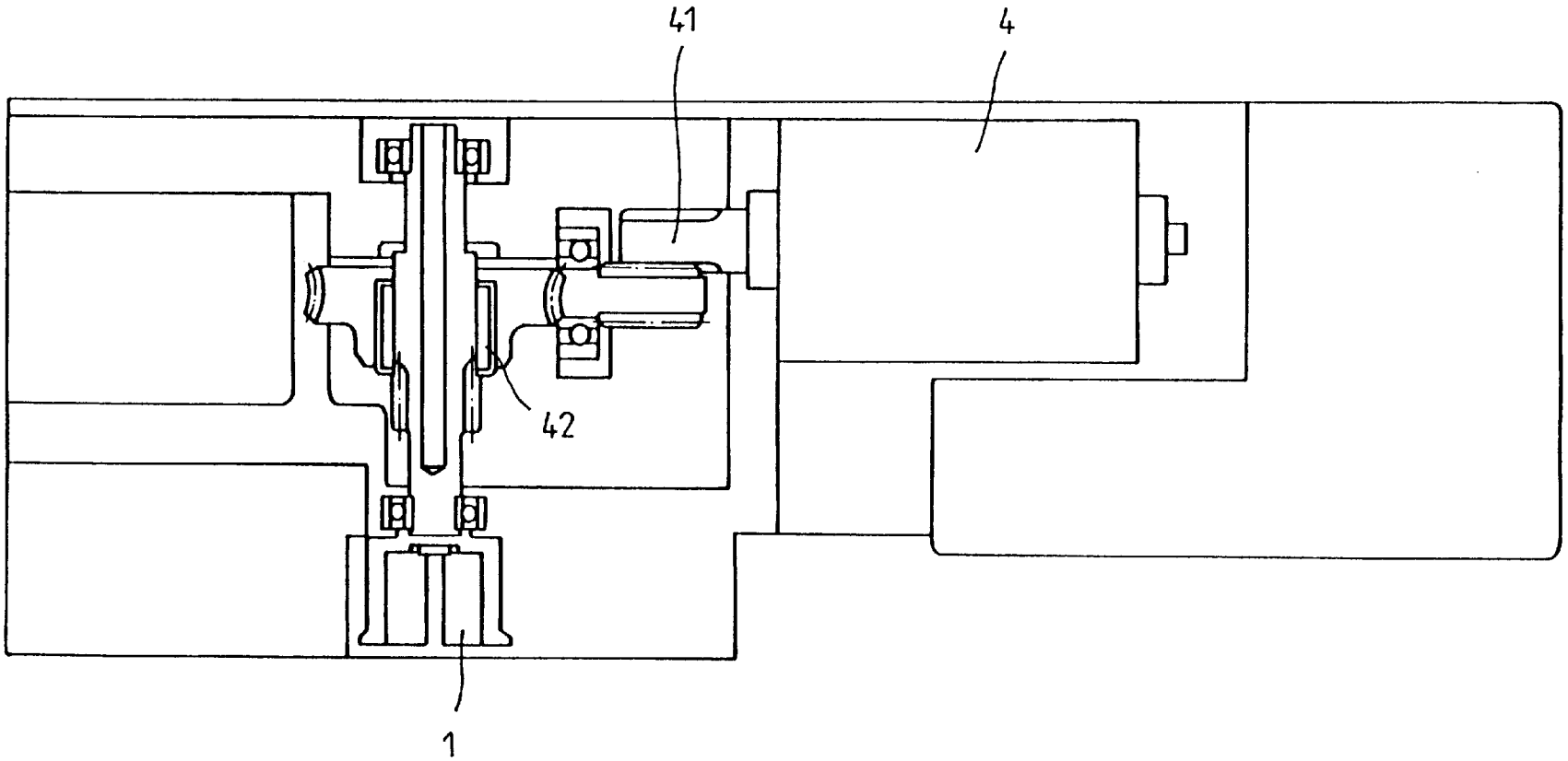
FIG. 3 is a plan view showing the arrangement of the transmission mechanism according to the invention.

As illustrated in FIGS. 2 and 3, the apparatus according to the invention is characterized in the innovative design of the tensioning wheel (1). The tensioning wheel (1) is coupled with the transmission mechanism through a unidirectional bearing (42). The tensioning wheel (1) is provided on the outer wall with a plurality of slots (11) arranged crosswise or in other symmetrical manners. A strapping band **(6*a*) extends through these slots (11). In addition, a presser roller(12) is disposed at a higher place to press against the outer wall surface of the tensioning wheel (1). The presser roller(12) is connected to a spring (13), one end of which spring is wound around a rod (21) of the base plate (2). Thus the elastic force of the spring (13) makes the presser roller(12) abut against the outer wall surface of the tensioning wheel (1). The middle segment of the spring (13) lies on the slant face of a raised block (34) of a link (33). The link (33) is pivoted at one end to the upper portion of a rear pawl (32)**.

Figure 4:
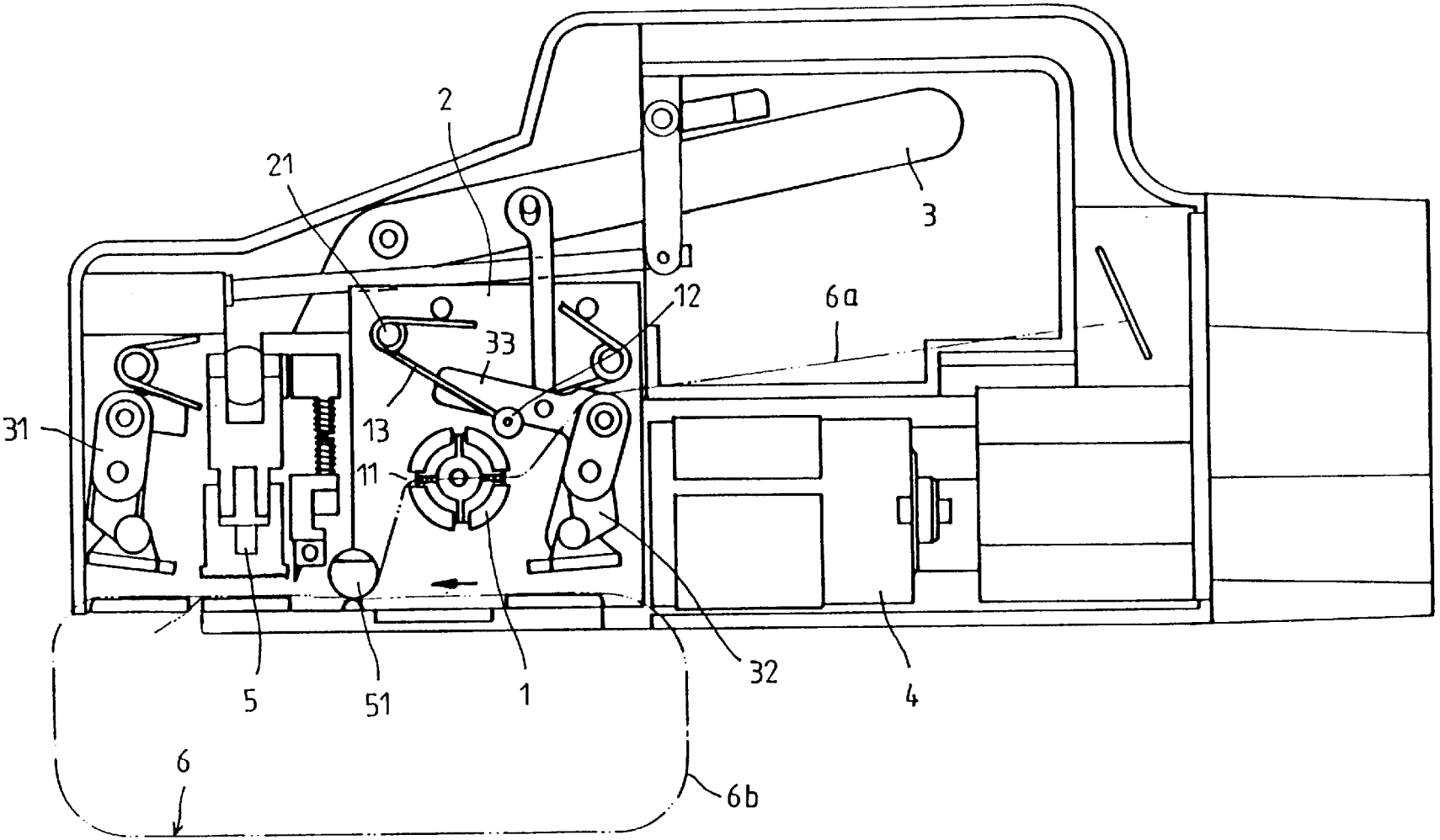
FIGS. 4 and 5 are plan views illustrating the movement of various mechanisms in the apparatus when operated.
Figure 5:
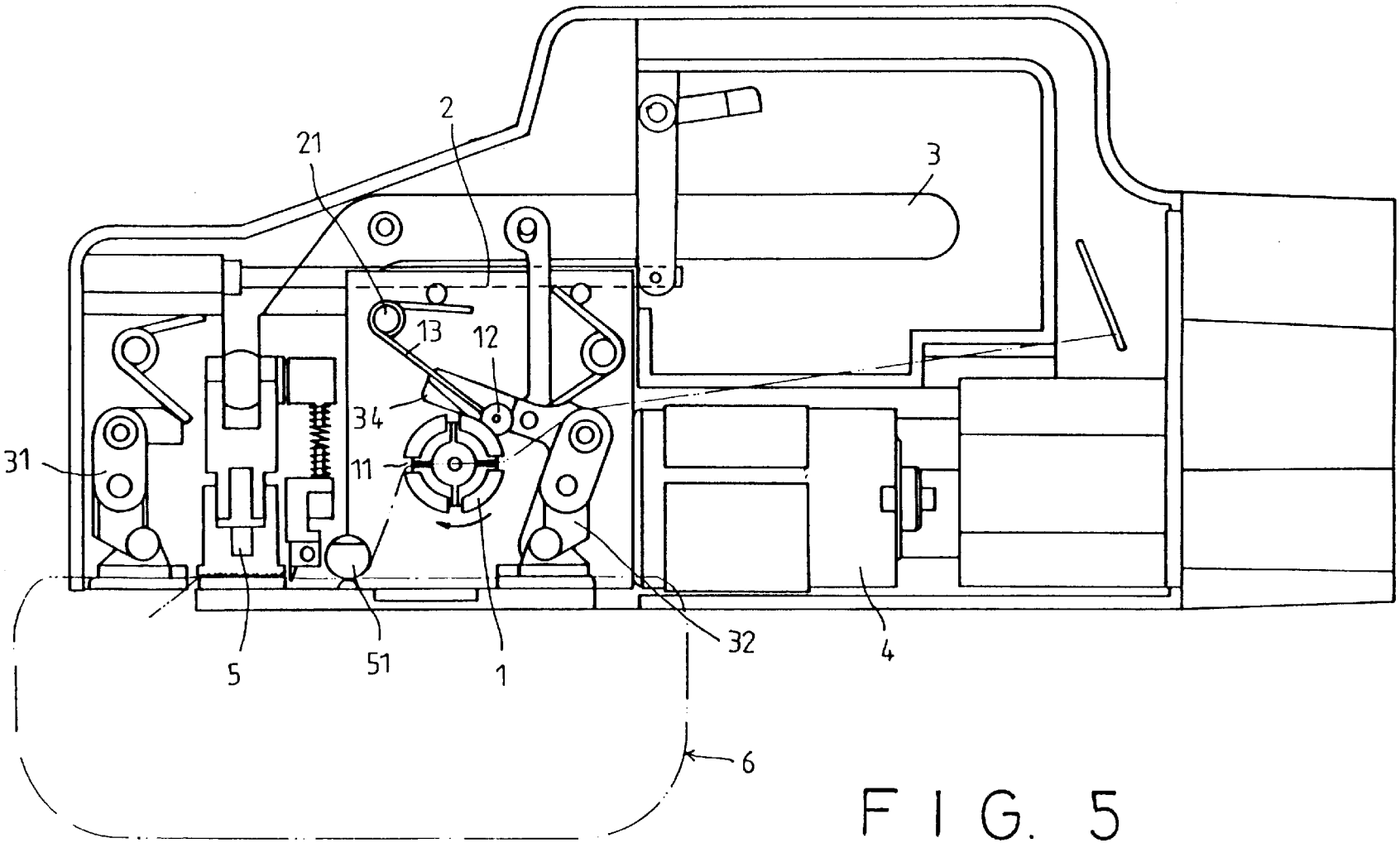

The operation of the apparatus is explained with reference to FIGS. 4 and 5. The handle (3) is first lifted to bring the pawl (31) and (32) to rise so that a strapping band (6) can be easily installed beneath. The outer end **(6*b*) of the strapping band (6) passes under the front pawl (31) and the inner end (6*a*) extends under the welding mechanism (5) to form an upper layer over the outer end. After passing underneath the welding mechanism (5), the. inner end (6*a*) continues to pass below a positioning cylinder (51), which keeps the strapping band in a horizontal position to facilitate the welding operation. After that, the inner end (6*a*) of the strapping band (6) passes through the slots (11) of the tensioning wheel (1). Then the handle (3) is lowered. In this way two pawls (31) and (32) can firmly hold the strapping band to achieve a temporarily securing effect. When the motor (4) starts, a shaft (41) brings the transmission mechanism to move. This causes the unidirectional bearing (42) to drive the tensioning wheel (1) to turn clockwise. As a result the strapping band (6*a*) is gradually strained and wrapped around the outer wall surface of the tensioning wheel under the presser roller(12). In this case the elastic force of the spring (311) confines the swinging motion of the front pawl (31) in a single direction. Accordingly the band can only move in a single direction. Thus it can be kept in a tensioned state without any slack. This is known to the skilled in the field and so will not be explained here in detail. The tensioning wheel (1) grasps the strapping band (6*a*) by means of a plurality of slots (11) and so it can exert an excellent pulling force on the band. Consequently the apparatus according to the invention can effectively fasten an object. This is what a conventional electrical tensioning mechanism can not achieve. The motor stops as a preset binding strength is reached. At this moment, the strapping band (6) is still strained. The automatic welding mechanism (5) can not make two layers of band in touch with each other when it descends. According to the invention, the tensioning wheel (1) is coupled with the transmission mechanism through a unidirectional bearing (42). When the shaft (41) turns in reversal to drive the welding mechanism (5) the tensioning wheel (1) becomes free to turn in either direction. Therefore, the strapping band (6) can be released at this moment. With the aid of the presser roller(12) the strapping band (6) can be gradually released before welding. Hence the welding mechanism (5)** can press the upper layer of band against the lower layer of band and rub them to reach the welding and breaking purposes. As a result, the strapping apparatus of the invention can achieve the goals set forth in the beginning of the text.

From the above description, obviously the innovative structure of the invention can be used in a semi-automatic strapping apparatus to promote its efficiency of fastening an object and effectively enhance the binding strength. The structure has significant advantage over the conventional one and it meets the essence of a patent. We hereby apply for a grant of patent.

What is claimed is:

1. A portable strapping apparatus comprising a base plate on which a motor, a transmission mechanism, a welding mechanism, a handle and a tensioning wheel are mounted; said motor driving the transmission mechanism to govern the operation of the tensioning wheel and the welding mechanism, and said handle moving a front and a rear pawl to locate the strapping band; and characterized in that said tensioning wheel is coupled with said transmission mechanism through a unidirectional bearing and is provided on the outer wall with a plurality of slots that allow strapping bands passing through, and in that a presser roller pressing against the outer wall surface of the tensioning wheel is connected to a spring mounted over a rod of the base plate and delivers the elastic force of the spring to the tensioning wheel; the middle segment of said spring lying on the slant face of a raised block of a link, the link being pivoted on one end to the upper portion of the rear pawl.

2. The portable strapping apparatus as claimed in claim 1, wherein when the shaft turns in reversal to drive the welding mechanism the tensioning wheel becomes free to turn so that the strapping band can be released and further the strapping band can be released in a slow and gradual manner with the help of the presser roller so that the welding mechanism can easily press and rub two layers of strapping bands against each other for welding and breaking.

3. The portable strapping apparatus as claimed in claim 1, wherein provided on one side of the welding mechanism is a positioning cylinder that keeps the strapping band near the welding mechanism in a horizontal position either in longitudinal or transversal direction.

4. The portable strapping apparatus as claimed in claim 1, wherein the tensioning wheel is coupled with the transmission mechanism through a unidirectional bearing and has a plurality of slots formed on the outer wall thereof to allow strapping bands passing through.

* * * * *